United States Patent [19]

Dauth

[11] 4,029,282

[45] June 14, 1977

[54] WALL BRACKET AND CLIP ARRANGEMENT

[75] Inventor: Michael F. Dauth, Montreal, Canada

[73] Assignee: Metalworks Limited, Quebec, Canada

[22] Filed: May 2, 1975

[21] Appl. No.: 573,986

[52] U.S. Cl. ..... 248/221.1

[51] Int. Cl.[2] ..... A47F 5/00

[58] Field of Search ..... 248/223, 224, 220, 220.5, 248/DIG. 3; 211/191, 192, 190; 403/187

[56] References Cited

UNITED STATES PATENTS

| | | | |
|---|---|---|---|
| 2,614,701 | 10/1952 | Mapson | 248/223 |
| 2,761,640 | 9/1956 | Frater | 248/DIG. 3 |
| 2,913,210 | 11/1959 | Tichnor | 248/DIG. 3 |
| 3,901,611 | 8/1975 | Simonsen | 403/187 |

FOREIGN PATENTS OR APPLICATIONS

| | | | |
|---|---|---|---|
| 243,613 | 10/1962 | Australia | 248/DIG. 3 |
| 797,732 | 7/1958 | United Kingdom | 248/DIG. 3 |

*Primary Examiner*—Roy D. Frazier

*Assistant Examiner*—Terrell P. Lewis

*Attorney, Agent, or Firm*—Diller, Brown, Ramik & Wight

[57] ABSTRACT

This invention relates to an assembly which is used for supporting objects on a wall surface and which is mounted on the wall surface to support the objects. The assembly includes a first or rail member which is mounted on the wall surface and which has a front member with a front surface which front surface is spaced from the wall surface by side walls and which is substantially parallel to the wall surface. The front surface includes a plurality of spaced openings which may be arranged along two rows with an opening in one row being disposed between two adjacent openings in the other row. The assembly also includes a clip means with a base member having a hanger means extending from one surface and hook means extending from the other surface. The hook means are spaced to match the spacing of the openings, and the space between the inner surface of each hook means and the other surface of the base is less than the thickness of the front member of the rail.

5 Claims, 5 Drawing Figures

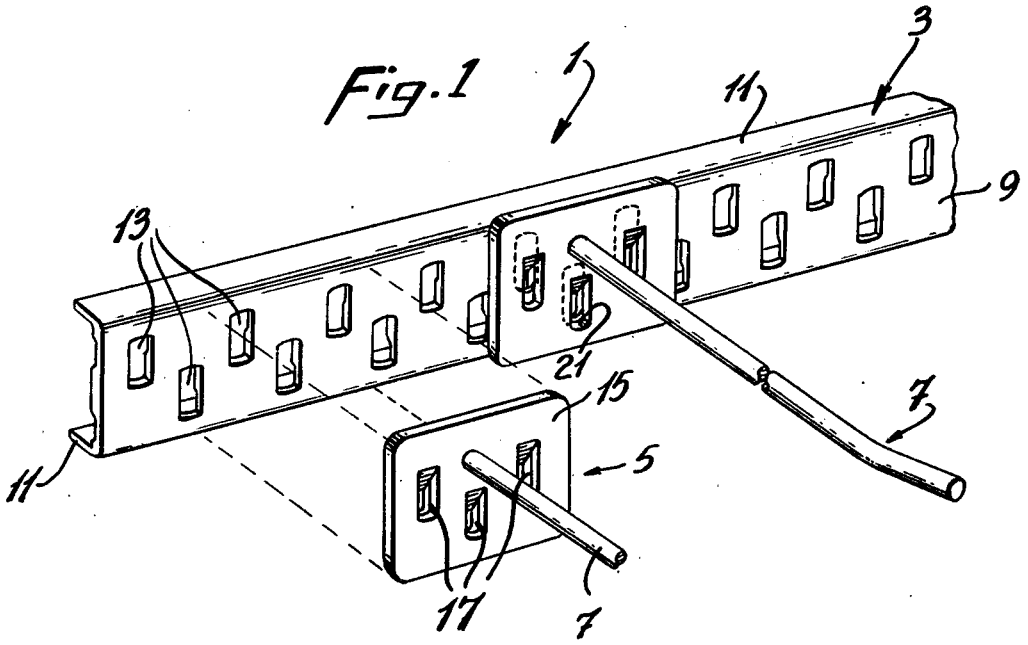
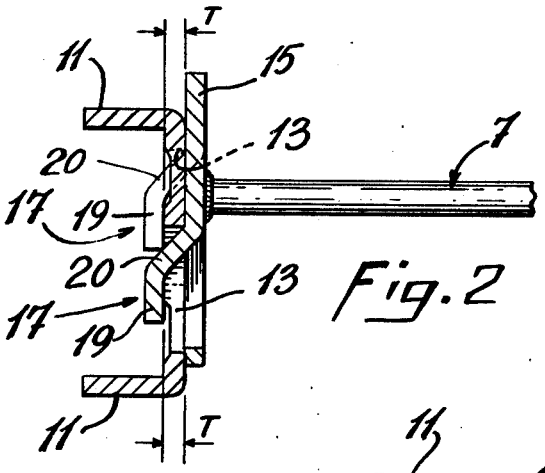
Fig. 2
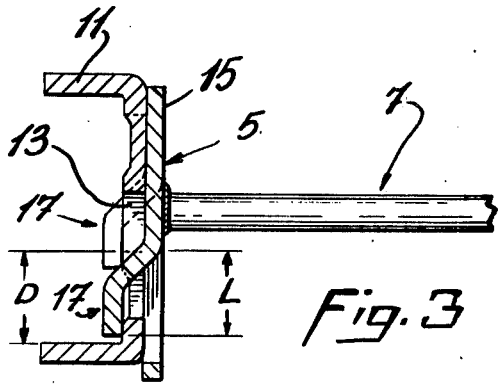
Fig. 3

WALL BRACKET AND CLIP ARRANGEMENT

BACKGROUND OF THE INVENTION

1. Field of the Invention

This invention relates to an assembly for supporting objects from a wall surface, the assembly being adapted to be mounted on the wall surface. More specifically, the invention relates to such an assembly which includes a first member adapted to be mounted on the wall surface and comprising a plurality of openings, and a clip member having hook means adapted to engage in said openings, the hook members being adapted to holdingly engage the first member.

2. Description of the Prior Art

Assemblies for the above purpose are known in the art as illustrated in U.S. Pat. Nos. 3,591,117, Mazzetti, 3,409,260, Bleed, 3,195,846, Dahlhauser, 3,844,231, Peacock, and 2,841,353, Burdick. In the Mazzetti, Bleed and Dahlhauser patents, perforated boards are mounted on the wall surfaces, and hanger means are then mounted on the perforated boards. With such an arrangement, separate means are required for spacing the perforated boards from the wall surfaces, so that mounting the boards is a difficult and time consuming process.

The peacock patent does not relate to a wall mounted assembly, but rather to panel structures, and all the abovementioned patents as well as the Burdick patent teach assemblies wherein the hanger means are easily knocked off because of the relatively insecure attachments as between the hanger means and the wall mounted brackets or panel structures.

SUMMARY OF THE INVENTION

It is an object of the invention to provide an assembly which includes a first member for mounting on a wall surface which can be easily and conveniently mounted because it includes means for spacing a surface thereof from the wall surface.

It is a further object of the invention to provide such an assembly wherein the hanger means is firmly secured in openings on the first member by hook means on a base member of the hanger means, the spacing of the hook means form the base being less than the thickness of the material of the first member to provide a tight, secure fit.

In accordance with the invention, an assembly for supporting objects on a wall surface, the assembly being adapted to be mounted on the wall surface, comprises: a first member for mounting on the wall surface and comprising a front member having a front surface substantially parallel with the wall surface and spaced from the wall surface by first and second side walls at opposite ends of said front member. The front member comprises a material of a first thickness and a plurality of spaced openings. Clip means are provided for mounting on said first member and comprising a base member having a first surface and a second surface, hanger means extending from the first surface, and spaced hook means extending from the second surface, the spacing of the hook means matching the spacing of the openings for engaging in the openings of said first member. In accordance with the invention, the spacing between the inner surface of each hook means and the second surface of the base member is less than the first thickness of the material of the front member of the first member.

The hook means may be punched out of its base member and comprise the material of its base member.

Preferably, each hook member comprises a downwardly extending leg substantially parallel with the base member, and a bridging portion extending between the base and a respective leg; the bridging portion being at an angle of less than 90° to the base member. Preferably, the angle between the bridge portion and the base member is 45°.

The plurality of openings in the first member may be disposed along an upper row and a lower row, the opening in any row being disposed between two adjacent openings in the other row.

The base member may comprises three hook means disposed in an upper row and a lower row, the upper row comprising two of the hook means, the third hook means being disposed in the lower row between the hook means in the upper row.

BRIEF DESCRIPTION OF THE DRAWINGS

The invention will be better understood by an examination of the following description, together with the accompanying drawings, in which:

FIG. 1 is a perspective view of one embodiment of the invention;

FIG. 2 is a side view of FIG. 1 with the clip member loosely mounted on the rail member; and FIG. 3 is a side view of FIG. 1 with the clip member tightly mounted on the rail member.

DETAILED DESCRIPTION OF THE DRAWINGS

Referring now to FIG. 1, the assembly, illustrated generally at 1, includes a wall mounted first member 3, and a clip member 5 including hanger means 7. The first member, in this case a wall mounted rail, has a front member having a front surface 9, which is mounted substantially parallel to the surface of the wall on which it is mounted, and is spaced from the wall surface by side walls 11, at either end of the first surface and substantially perpendicular thereto. The spacing means 11 simplifies the mounting of the first member and provides a space behind the front member for enclosing hook means as will be described below.

As will be appreciated, the front member will include screw holes (not shown) for screwing the rail up against the wall.

The front member also includes a plurality of openings 13 which, in the illustrated embodiment, are arranged in two rows, the openings being so disposed that an opening in one row is between two adjacent openings in the other row.

The clip member 5 includes a base member 15, and the hanger means 9 extends from one surface of the base member. Extending from the other surface of the base member are hook means 17 which can be better seen in FIGS. 2 and 3. In the preferred embodiment, the hook means are punched out of the base member, although it is within the scope of the invention to provide hook means made independently of the base member and separately attached thereto. In the illustrated embodiment, the base member includes three hook means disposed in two rows. Two of the hook means are in the top row, and the third is in the bottom row and disposed between the two hook means in the top row. As will be apparent from the following, other arrangements for the hook means are possible. Thus, the base can comprise five hook means disposed in two rows with three on top and two on the bottom. Or other arrangements could be used. It is only necessary that the spacing of the hook means match the spacing of the openings 13 so that the hook means can engage the openings as described below.

As seen in FIG. 2, the hook means includes a downwardly extending leg 19, substantially parallel to the base member 15, and a bridging portion 20. In accordance with the invention, the spacing between the inner surface of the leg 19 and the other surface of the base member is less than the thickness T of the material of the front member of the first member. In this way, when the hook means is force fitted over the respective areas of the front member, it will tightly and securely engage the front member so that it cannot be easily knocked off.

Further, in order to secure the clip more firmly, the bridge portion 20 is at an angle of less than 90° to the base member 15. With this arrangement, a tighter fit is provided by a wedging action between the bridge portion and the adjacent area of the first surface when the clip is force fitted on the rail. In the illustrated embodiment, the angle is substantially 45°.

The hook means are also constructed so that their bottom radii 21 (see FIG. 1) are smaller than the bottom radii of the openings 13. In this way, the bottom of each hook member will make gradual contact with the bottom of its respective opening in a camming-like action to ease the mounting of the clip on the rail.

In operation, the assembly works as follows:

The base of the clip is placed close to the wall mounted rail with the hook members disposed adjacent to respective openings, and the hook members are slid into their respective openings. The clip is then pushed downwardly for initial loose contact with the rail. Although the spacing between the inner surface of the hook members and the other surface of the base member is less than the thickness T, the camming action above-mentioned will permit manual mounting to a position shown in FIG. 2.

A greater force, such as by hammering, is then applied at the top of the clip member to force fit it into the final position shown in FIG. 3. As can be seen, in this final position, there is a wedging action as between the bridge portion 20 and the bottom of a respective opening which causes a tighter, more secure engagement between the clip member and the rail. In fact, it would take a similar hammering action at the bottom of the clip member to remove the clip member from the rail.

The advantages of the inventive assembly are as follows:

Because of the self spacing arrangement of the first or rail member, mounting of this member on a wall surface is simplified. In addition, the arrangement provides greater support, and a heavier weight can be supported on this assembly than on known assemblies.

The spacing between the inner surface of each hook and the other surface of the base being less than the thickness of the first member, and the wedging action of the bridge portion, provides a tighter fit between the clip and the rail so that the clip cannot be easily knocked off the rail.

In addition, with the inventive assembly, the clip means can be mounted on the rail by a straight horizontal motion of the clip means, i.e. it is not necessary to tilt the clip means in order to mount it on the rail.

Although preferred embodiments have been described above, this was for the purpose of illustrating, but not limiting, the invention. Various modifications, which will come readily to the mind of one skilled in the art, are within the scope of the invention as defined in the appended claims.

I claim:

1. An assembly for supporting objects on a wall surface, said assembly being adapted to be mounted on said wall surface, and comprising, a longitudinally extending rail for mounting on said wall surface and comprising a front member having a front surface substantially parallel with said wall surface and spaced from said wall surface by first and second side walls at opposite ends of said front member, said first and second side walls extending at substantially 90° to said front member;

said front member comprising a material of a first thickness;

said front member comprising a plurality of spaced openings, said spaced openings being disposed along an upper row and a lower row, the opening in any row being disposed between two adjacent openings in the other row;

a clip means for mounting on said rail and comprising:

a base member having a first surface and a second surface;

hanger means extending from said first surface;

three spaced hook means extending from said second surface, the spacing of said hook means matching the spacing of said openings for engaging in said openings of said rail, said three hook means being disposed in an upper row and a lower row, said upper row comprising two of said hook means, the third hook means being disposed in said lower row between said hook means in said upper row;

the spacing between the inner surface of each hook means and the second surface of the base member being less than the first thickness of the material of the front member of said rail.

2. An assembly as defined in claim 1 wherein each hook means is punched out of its base member and comprises the material of its base member.

3. An assembly as defined in claim 2 wherein each hook member comprises a downwardly extending leg substantially parallel with said base member, and a bridging portion extending between said base and a respective leg; said bridging portion being at an angle of less than 90° to said base member.

4. An assembly as defined in claim 3 wherein the angle between said bridge portion and said base member is 45°.

5. An assembly as defined in claim 1 where each said hook means is shaped so as to include a radius at the bottom end thereof, and where each said opening is shaped to include a radius at the bottom end thereof;

characterized in that the bottom radii of the hook means are smaller than the bottom radii of the openings.

* * * * *